US010722020B2

(12) United States Patent
Chung et al.

(10) Patent No.: US 10,722,020 B2
(45) Date of Patent: Jul. 28, 2020

(54) DOUBLE WIPING STRUCTURE FOR TOOTHBRUSH-TYPE MASCARA WAND

(71) Applicant: CTK CO., LTD., Gyeonggi-do (KR)

(72) Inventors: In Yong Chung, Seoul (KR); Jung Hun Jun, Daejeon (KR)

(73) Assignee: CTK CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/167,132

(22) Filed: Oct. 22, 2018

(65) Prior Publication Data

US 2020/0121060 A1 Apr. 23, 2020

(51) Int. Cl.

| | |
|---|---|
| ***A46B 17/08*** | (2006.01) |
| ***A45D 34/04*** | (2006.01) |
| ***A46B 9/04*** | (2006.01) |
| ***A45D 40/26*** | (2006.01) |

(52) U.S. Cl.

CPC ..... *A45D 34/046* (2013.01); *A45D 40/267* (2013.01); *A46B 9/04* (2013.01); *A46B 2200/1053* (2013.01)

(58) Field of Classification Search

CPC ..... A45D 34/046; A45D 40/267; A46B 2200/1053

USPC ..... 401/122

See application file for complete search history.

(56) References Cited

U.S. PATENT DOCUMENTS

| | | | | |
|---|---|---|---|---|
| 8,231,297 | B2 * | 7/2012 | Legassie | A45D 40/267 401/117 |
| 10,271,630 | B2 * | 4/2019 | Yoo | A45D 34/00 |

FOREIGN PATENT DOCUMENTS

| | | |
|---|---|---|
| KR | 200230152 | 4/2001 |
| KR | 200397604 | 9/2005 |
| KR | 200442004 | 9/2008 |

* cited by examiner

*Primary Examiner* — Jennifer C Chiang

(74) *Attorney, Agent, or Firm* — IPLA P.A.; James E. Bame

(57) ABSTRACT

A double wiping structure of a mascara wand provides an amount of mascara required to be applied to the eyelashes by causing a brush rod provided with a brush to be discharged along a ring member from a container so that mascara adhered to the brush rod is wiped using a first wiper and mascara adhered to the brush is wiped using a second wiper. The double wiping structure prevents mascara adhered to the brush from coming into contact with the inner surface of a wiper body and consequently prevents contamination of the inner surface of the wiper body due to the mascara by causing the ring member to be moved along the inner surface of the wiper body by pressure applied from the brush rod when the brush rod is introduced into and discharged from the container.

3 Claims, 5 Drawing Sheets

DOUBLE WIPING STRUCTURE FOR TOOTHBRUSH-TYPE MASCARA WAND

BACKGROUND

The present invention relates to the double wiping structure of a mascara wand, and more particularly to the double wiping structure of a toothbrush-type mascara wand, which causes a brush rod provided with a brush to be discharged along a ring member from a container so that mascara adhered to the brush rod is wiped using a first wiper and mascara adhered to the brush is wiped using a second wiper, and in which the ring member prevents the mascara adhered to the brush from coming into contact with the inner surface of a wiper body while being moved along the inner surface of the wiper body by pressure applied from the brush rod when the brush rod is introduced into and discharged from the container.

In general, mascara is a cosmetic that thickens the eyelashes, and a user can apply the mascara, which is adhered to a brush and exposed through a brush rod while being stored in a container in a liquid or creamy phase, to the eyelashes.

When the mascara is applied with the brush and is discharged from the container upon use thereof, two wipers may be used to wipe a large amount of mascara on the brush rod and the brush. This may allow the user to apply an appropriate amount of mascara on the brush to the eyelashes.

A mascara container having two such wipers is disclosed in Korean Utility Model Registration No. 20-0397604.

In the registered Utility Model, an excessive amount of mascara adhered to a brush rod and a brush is wiped by first and second wipers having a two-stage structure, which are mounted on the front end portion of the mascara container, so as to allow a user to apply the mascara adhered to the brush to the eyelashes. However, since the brush sequentially passes through the first and second wipers, an amount of mascara required to be applied to the eyelashes may not be provided due to the wiping of the mascara adhered to the brush, and thus the user needs to repeatedly apply the mascara to the eyelashes, which is troublesome.

In addition, the mascara may spatter and be attached to the inner wall of the wiper when the brush passes through the wiper, which may contaminate the inside of the wiper and may require a complicated process of shaking and removing the mascara from the inner wall. This results in inconvenience in use.

SUMMARY OF THE INVENTION

Therefore, the present invention has been made in view of the above problems, and it is one object of the present invention to provide an amount of mascara required to be applied to the eyelashes by causing a brush rod provided with a brush to be discharged along a ring member from a container so that mascara adhered to the brush rod is wiped using a first wiper and mascara adhered to the brush is wiped using a second wiper.

In addition, it is another object of the present invention to prevent mascara adhered to a brush from coming into contact with the inner surface of a wiper body and consequently prevent contamination of the inner surface of the wiper body due to the mascara by causing a ring member to be moved along the inner surface of the wiper body by pressure applied from a brush rod when the brush rod is introduced into and discharged from a container.

In accordance with an aspect of the present invention, the above and other objects can be accomplished by the provision of a double wiping structure of a toothbrush-type mascara wand, the structure including a wiper body mounted to an upper end portion of a container in which contents are stored and including a first wiper formed on a front end portion thereof to scrape mascara adhered to a brush rod that is being discharged from the container, and a ring member configured to guide introduction and discharge of a brush into or from the container so that mascara adhered to the brush is scraped by a second wiper formed on a rear end portion of the wiper body when the brush rod is discharged and configured to prevent the brush from coming into contact with an inner surface of the wiper body while being moved along the wiper body by pressure applied from the brush rod that is being discharged.

The ring member includes a body having a tubular shape to define a hollow interior, a first stepped locking portion formed on an inner circumferential surface of the body and configured to be caught by a discharge guidance protrusion of the brush rod so that the pressure is applied from the brush rod to the ring member when the brush rod is discharged from the container, and a second stepped locking portion formed on an outer circumferential surface of the body and configured to stop movement of the ring member when caught by a stepped movement control portion of the wiper body.

The double wiping structure further includes a separation-preventing member mounted to a rear end of the wiper body so as to prevent separation of the ring member and to guide movement of the brush rod.

The separation-preventing member includes a body having a tubular shape to guide movement of the brush rod through a hollow interior thereof, and at least one fitting protrusion formed on an outer circumferential surface of the body.

The double wiping structure further includes a fitting space formed in the rear end portion of the wiper body so that the fitting protrusion is snap-fitted into the fitting space.

The second wiper is formed on one of the rear end portion of the wiper body and the separation-preventing member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, reference will now be made in detail to the exemplary embodiment of the present invention with reference to the accompanying drawings in order to allow those who skilled in the art to easily implement the present invention. However, the present invention may be implemented in various other forms and is not limited to the embodiment described herein.

Figure 1:
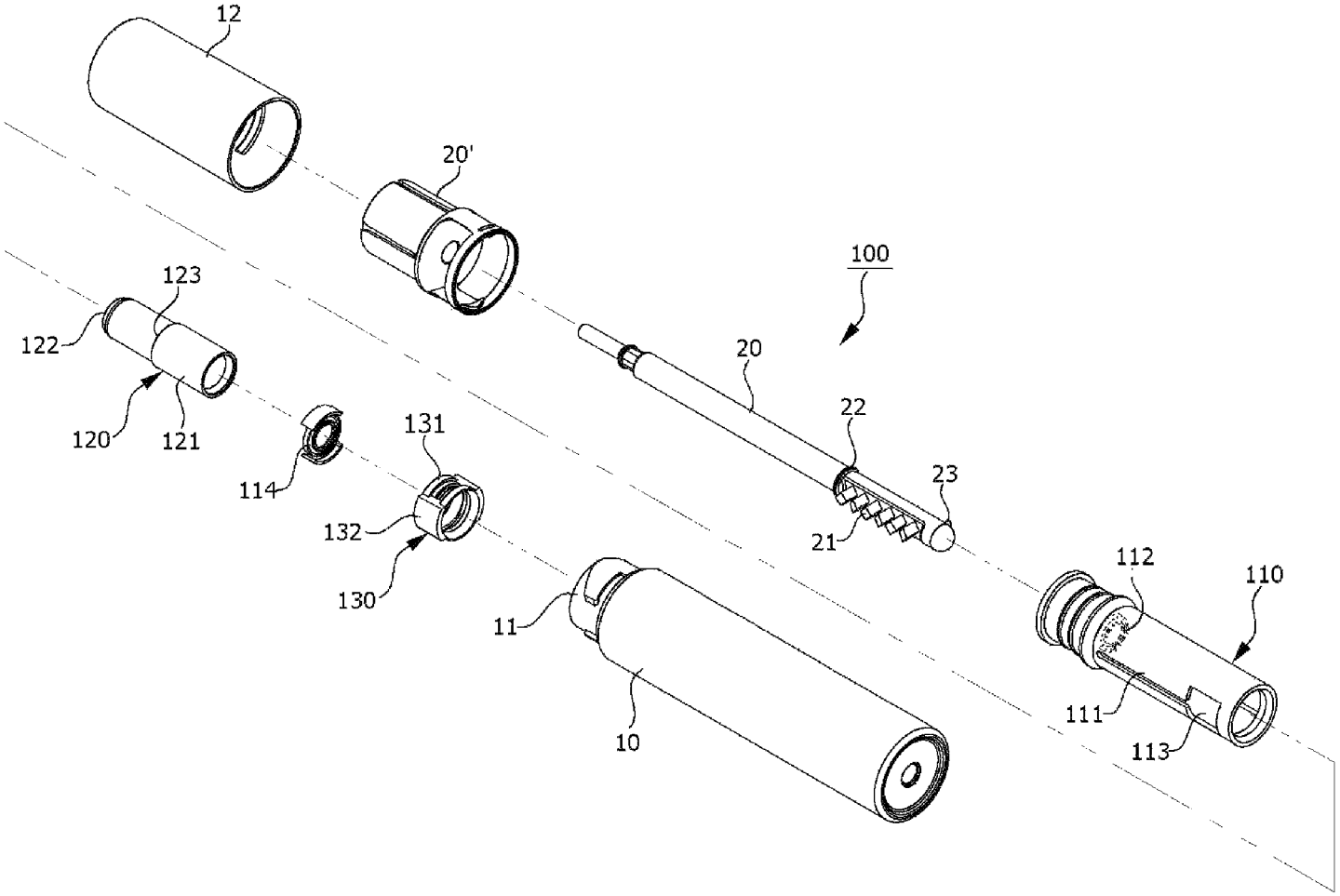
FIG. 1 is an exploded perspective view of the double wiping structure of a toothbrush-type mascara wand according to the present invention.

FIG. 1 is an exploded perspective view of the double wiping structure of a toothbrush-type mascara wand according to the present invention.

The double wiping structure of the toothbrush-type mascara wand according to the present invention includes a container 10, a brush rod 20 provided with a brush 21, a wiper body 110, a ring member 120, and a separation-preventing member 130.

The container 10 stores therein the contents such as mascara liquid. The container 10 is formed on the upper portion thereof with an outlet port 11, through which the contents are discharged. The container 10 includes a cap 12 detachably attached to the outlet port 11 in order to open and close the outlet port 11.

The brush rod 20 is configured in a manner such that the brush 21 is formed on the cut surface of one end to absorb and apply the contents and such that a fixing guidance member 20' is mounted on the other end so as to be inserted into the cap 12. The brush rod 20 may have the overall shape of a toothbrush.

In addition, the brush rod 20 is formed on opposite sides of the brush 21 with a discharge guidance protrusion 22 and an introduction guidance protrusion 23, which apply pressure to the ring member 120 in the direction of movement of the brush rod 20.

The wiper body 110 includes a body 111, which has a tubular shape so that the brush rod 20 and the brush 21 are movable through a hollow interior thereof. The body 111 is mounted on the upper end portion of the container 10. A first wiper 112 is formed on the inner circumferential surface of the body 111 to scrape the contents adhered to the brush rod 20.

In addition, the outer circumferential surface of the rear end portion of the body 111 is formed therein with a fitting space 113, into which a fitting protrusion 132 of the separation-preventing member 130 is snap-fitted.

The ring member 120 includes a body 121, which has a tubular shape defining a hollow interior, and a first stepped locking portion 122, which is formed on the inner circumferential surface of the body 121 and is caught by the discharge guidance protrusion 22 of the brush rod 20 so that pressure is applied from the brush rod 20 to the ring member 120 when the brush rod 20 is discharged from the container 10. In addition, the ring member 120 further includes a second stepped locking portion 123, which is formed on the outer circumferential surface of the body 121. In the state in which the discharge guidance protrusion 22 of the brush rod 20 is caught by the first stepped locking portion 122, after the body 151 is moved by a predetermined distance in the direction in which the brush rod 20 is discharged, the second stepped locking portion 123 is caught by a stepped movement control portion 110' of the wiper body 110 so that the movement of the body 121 is stopped.

In addition, the separation-preventing member 130 is mounted on the rear end of the wiper body 110 so as to prevent separation of the ring member 120 and to guide movement of the brush rod 20.

The separation-preventing member 130 includes a body 131, which has a tubular shape so as to guide the movement of the brush rod 20 through a hollow interior thereof, and at least one fitting protrusion 132 is formed on the outer circumferential surface of the body 131 so as to be snap-fitted into the fitting space 113 in the wiper body 110.

In addition, a second wiper 114 is formed on any one of the rear end portion of the wiper body 110 and the separation-preventing member 130 to scrape mascara adhered to the brush 21.

Next, the use procedure of the cosmetic container of the present invention having the above-described configuration will be described.

Figure 2:
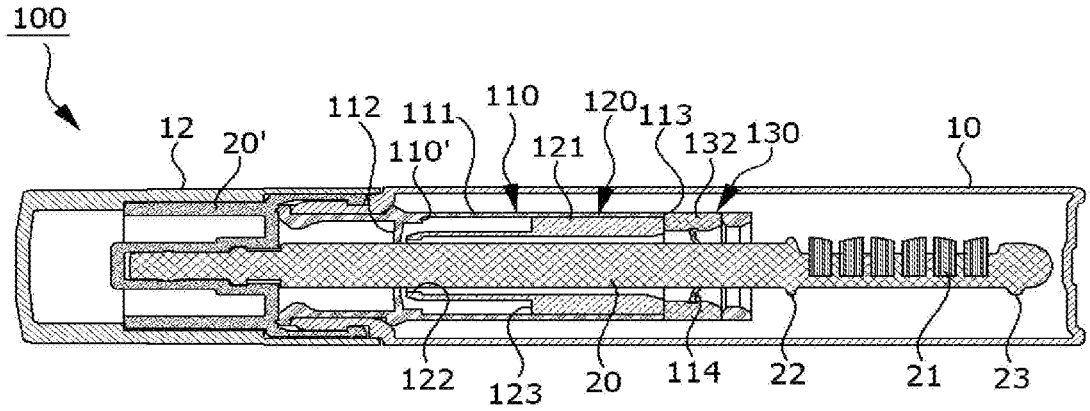
FIG. 2 is a cross-sectional view of the double wiping structure of the toothbrush-type mascara wand according to the present invention.

First, as illustrated in FIG. 2, the body 121 of the ring member 120 is inserted into the body 111 of the wiper body 110 so that the ring member 120 is movable along the interior of the wiper body 110. Then, the separation-preventing member 130 is coupled to the rear end portion of the wiper body 110 in order to prevent separation of the ring member 120.

At this time, the fitting protrusion 132 formed on the outer circumferential surface of the body 131 of the separation-preventing member 130 is snap-fitted into and fixed to the fitting space 113 in the wiper body 110, which may prevent separation of the ring member 120.

Here, at least one fitting protrusion 132 and at least one fitting space 113 may be provided so as to face each other.

Subsequently, after the wiper body 110, which has been coupled to the ring member 120, is inserted into the container 10 in which the contents such as mascara are stored so that the front end portion of the wiper body 110 is seated in the outlet port 11 of the container 10, the brush rod 120, which is mounted in the cap 12 with the fixing guidance member 20', is moved into the body 111 of the wiper body 110.

The end of the brush rod 20, which has been moved into the body 111, is coupled to the end of the body 121 of the ring member 120, and at the same time, the introduction guidance protrusion 23 of the brush rod 20 is caught by the end of the body 121 of the ring member 120. In this state, when the brush rod 20 is moved into the container 10, the introduction guidance protrusion 23 of the brush rod 20 applies pressure to the end of the body 121 of the ring member 120, whereby the ring member 120 is moved into the container 10 by the pressure applied thereto from the brush rod 20.

When the end of the body 121 of the ring member 120, which has been moved into the container 10, is caught by the separation-preventing member 130, the movement of the ring member 120 is stopped. Even in the state in which the movement of the ring member 120 is stopped, the brush rod 20 is moved so as to be introduced into the container 10.

At this time, the introduction guidance protrusion 23 of the brush rod 120, which has a curved shape, passes through the first stepped locking portion 122 of the ring member 120, and the brush 21 and the discharge guidance protrusion 22 of the brush rod 120 sequentially pass through the first stepped locking portion 122 of the ring member 120, so that the brush 21 of the brush rod 20 is located inside the container 10. In this state, the cap 12 is mounted around the outlet port 11 of the container 10 to close the outlet port 11, whereby the manufacture of a cosmetic container 100 may be completed.

Figure 3:
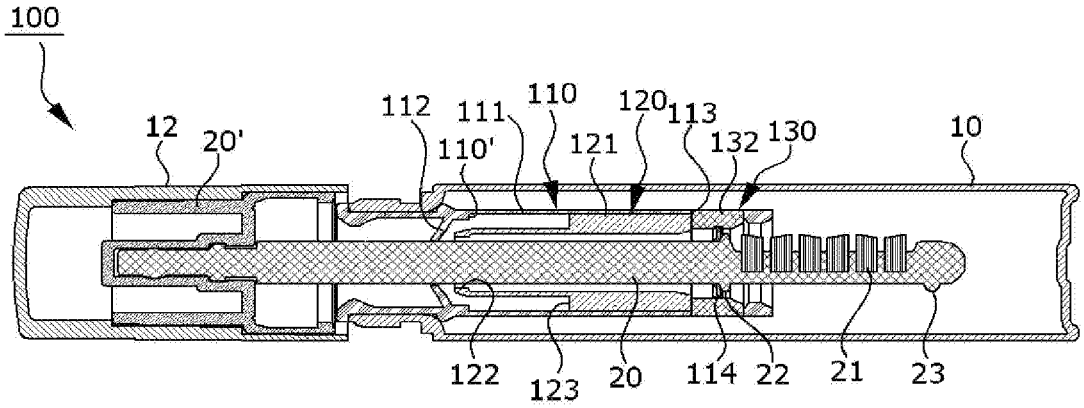
FIGS. 3 to 6 are views illustrating the operational state of the double wiping structure of the toothbrush-type mascara wand according to the present invention.

When attempting to use the contents such as mascara stored in the cosmetic container 100 manufactured through the above-described procedure, as illustrated in FIG. 3, the user rotates the cap 12 to release the cap 12 from the outlet port 11, and then moves the cap 12 away from the container 10, i.e., so as to be separated from the container 10.

Figure 4:
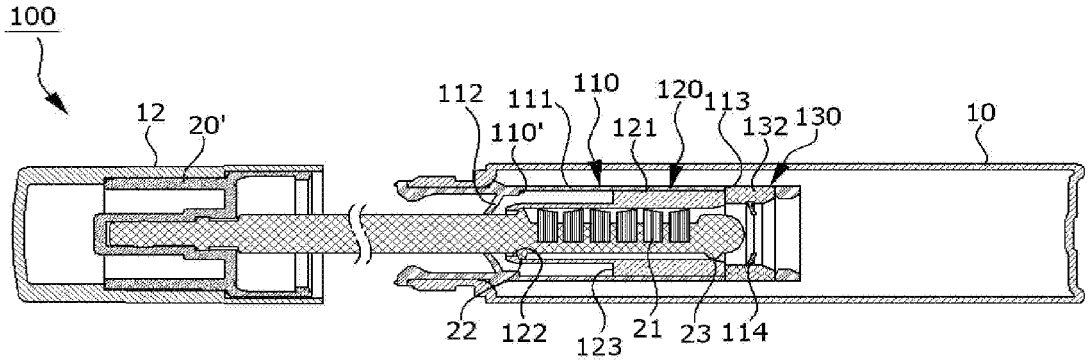

When the cap 12 is moved away from the container 10, the brush rod 20 mounted in the cap 12 is also moved away from the container 10. Thereby, as illustrated in FIG. 4, the contents such as mascara adhered to the outer circumferential surface of the brush rod 20, which is moved away from the container 10, is scraped by the first wiper 112 formed on the inner circumferential surface of the body 111 of the wiper body 110. In addition, the second wiper 114, which is formed on any one of the rear end portion of the wiper body 110 and the separation-preventing member 130, secondarily scrapes the contents such as mascara adhered to the outer circumferential surface of the brush rod 20 while remaining in close contact with the outer circumferential surface of the brush rod 20. In this way, it is possible to minimize the movement of the contents such as mascara outwards from the container 10 along with the brush rod 20.

The discharge guidance protrusion 22 of the brush rod 20 is passed through the second wiper 114 when the brush rod 20 is moved away from the container 10, and at the same time, the second wiper 114 scrapes the contents such as mascara adhered to the brush rod 20 and the contents such as mascara adhered to the upper end portion of the brush 21. Then, the introduction guidance protrusion 23 of the brush rod 20 is passed through the second wiper 114 and is moved into the body 121 of the ring member 120.

Figure 5:
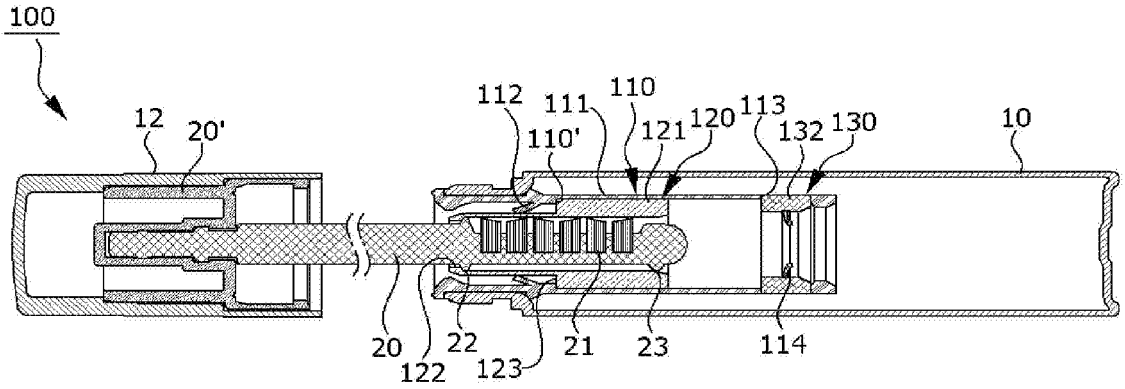

In addition, as illustrated in FIG. 5, as the brush rod 20 is moved into the body 121 of the ring member 120, the discharge guidance protrusion 22 of the brush rod 20 is caught by the first stepped locking portion 122 of the ring member 120. In this state, the ring member 120 is moved in the direction of movement of the brush rod 20.

At this time, when the ring member 120 is moved in the state in which the front end portion of the ring member 120 pushes the first wiper 122 so that the first wiper 112 is brought into close contact with the outer circumferential surface of the ring member 120, the second stepped locking portion 123 of the ring member 120 is caught by the stepped movement control portion 110' of the wiper body 110 and the movement of the ring member 120 is stopped. At the same time, since the front end portion of the ring member 120 is located on the front end portion of the body 111 of the wiper body 110, it is possible to prevent contamination of the interior of the wiper body 110 due to the contents such as mascara and to ensure simplified use of the contents such as mascara.

Figure 6:
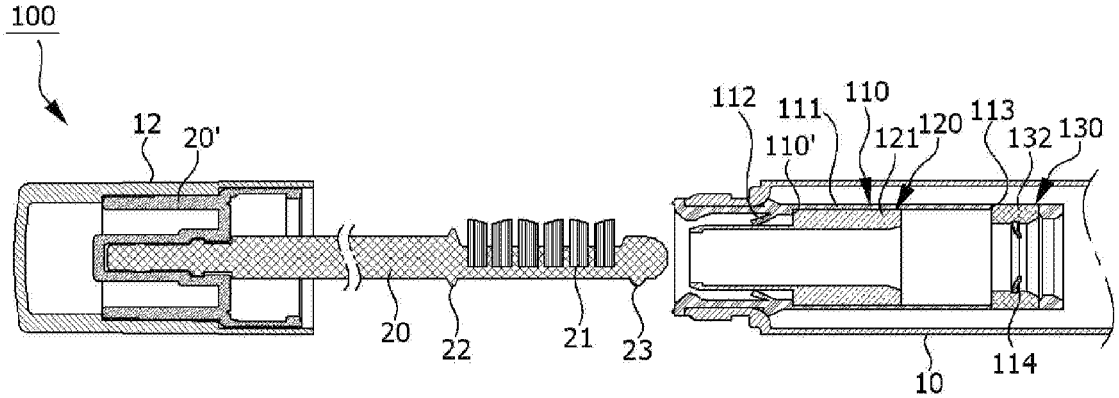

When the brush rod 120 continues to be moved away from the container 10 in the state in which the front end portion of the ring member 120 is located on the front end portion of the wiper body 110, as illustrated in FIG. 6, the first stepped locking portion 122 of the ring member 120 is deformed so as to expand outwards by the pressure applied from the discharge guidance protrusion 22 of the brush rod 20. The deformed first stepped locking portion 122 is restored to the original state by the elasticity thereof at the same time as the discharge guidance protrusion 122 passes through the first stepped locking portion 122.

When the introduction guidance protrusion 23 passes through the restored first stepped locking portion 122 while scraping some of the contents adhered to the brush 121 and the contents adhered to the outer circumferential surface of the brush rod 20 formed with the brush 21, the brush rod 20 is discharged from the container 10, and the user can easily apply the contents such as mascara adhered to the brush 21 of the discharged brush rod 20 while repeating the above-described procedure.

Figure 7:
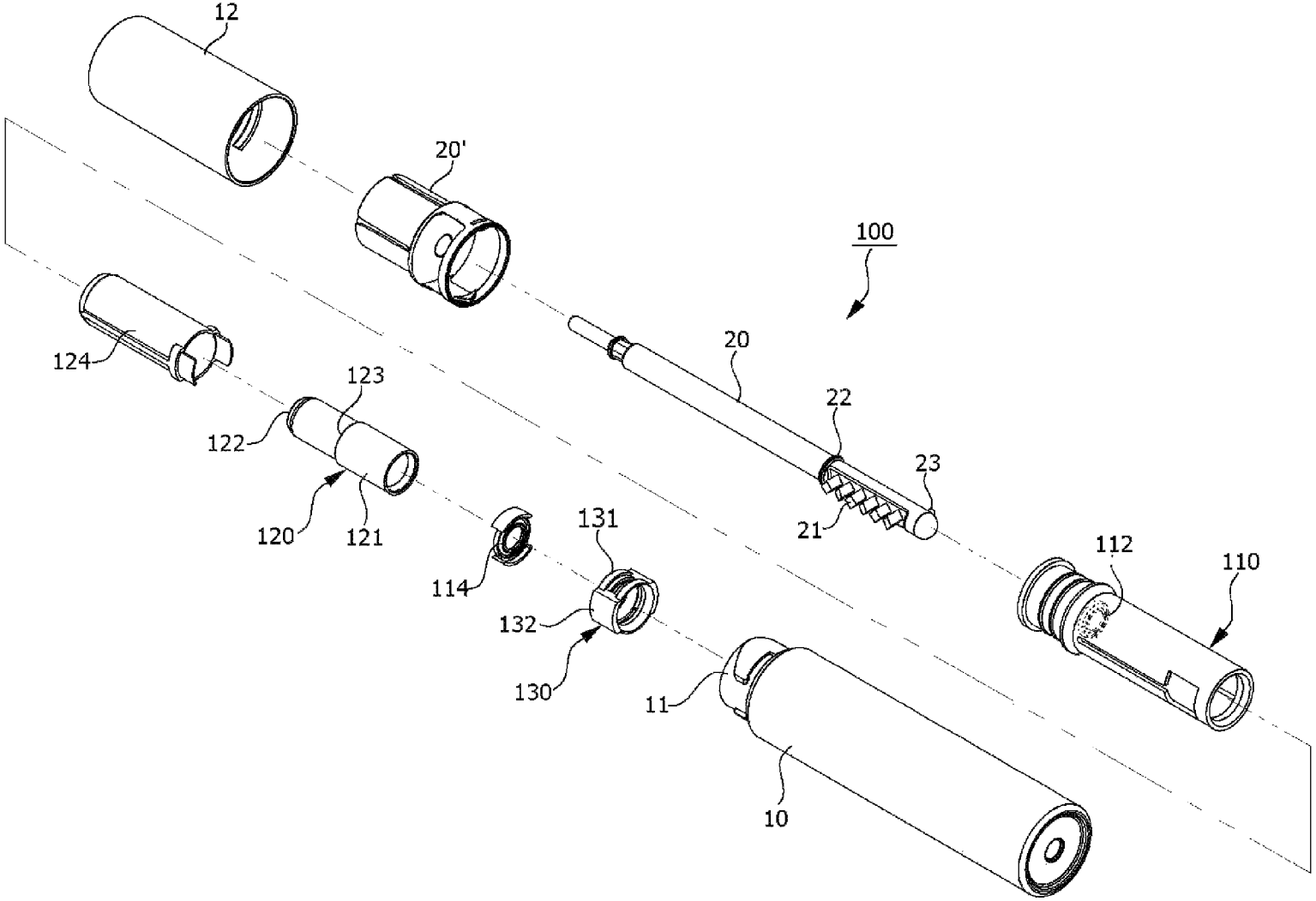
FIG. 7 is an exploded perspective view illustrating another embodiment of the double wiping structure of the toothbrush-type mascara wand according to the present invention.
Figure 8:
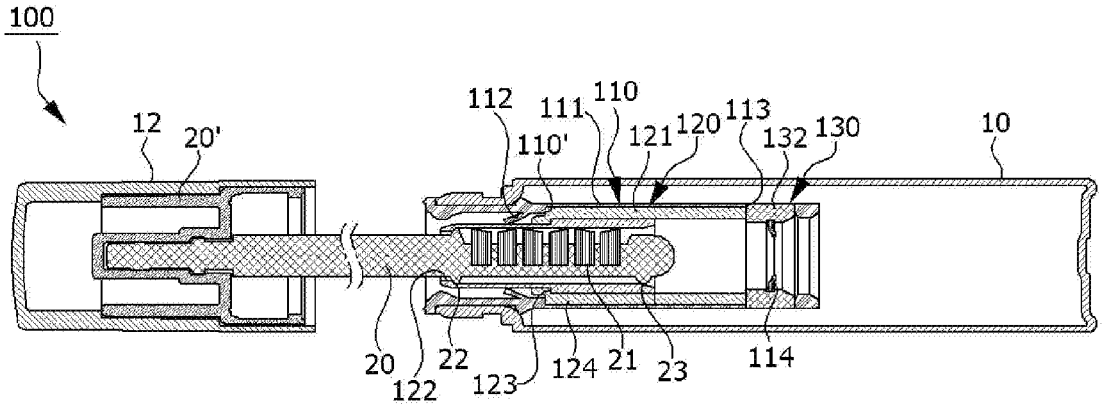
FIG. 8 is a cross-sectional view of the other embodiment of the double wiping structure of the toothbrush-type mascara wand according to the present invention.

In addition, as illustrated in FIGS. 7 and 8, a ring guide 124 may be provided between the ring member 120 and the wiper body 110 so as to guide movement of the ring member 120. Needless to say, it is necessary for the ring guide 124 to be formed on the inner circumferential surface thereof with a stepped portion, which is caught by the second stepped locking portion 123 of the ring member 120 and performs control to stop movement of the ring member 120, and also to be formed on the outer circumferential surface thereof with a stepped portion, which is coupled to the stepped movement control portion 110' of the wiper body 110 to prevent movement of the ring guide 124.

As is apparent from the above description, according to the present invention, a brush rod provided with a brush is discharged along a ring member from a container so that mascara adhered to the brush rod is wiped using a first wiper and mascara adhered to the brush is wiped using a second wiper. Thereby, it is possible to provide an amount of mascara required to be applied to the eyelashes, which may ensure convenience in use.

In addition, according to the present invention, by causing the ring member to be moved along the inner surface of a wiper body by pressure applied from the brush rod when the brush rod is introduced into and discharged from the container, it is possible to prevent mascara adhered to the brush from coming into contact with the inner surface of the wiper body. Thereby, it is possible to prevent the inner surface of the wiper body from being contaminated due to the mascara and to ensure easy application of the mascara.

Although the preferred embodiment of the present invention has been disclosed with reference to the accompanying drawings for illustrative purposes, those skilled in the art will appreciate that various modifications, additions and substitutions are possible, without departing from the scope and spirit of the invention as disclosed in the accompanying claims.

Hence, the scope of the present invention should not be limited to and defined by the above-described embodiment, but should be defined by the following claims and equivalents of the claims.

What is claimed is:

1. A double wiping structure of a toothbrush-type mascara wand, the structure comprising:

a wiper body mounted to an upper end portion of a container in which contents are stored and comprising a first wiper formed on a front end portion thereof to scrape mascara adhered to a brush rod that is being discharged from the container;

a ring member configured to guide introduction and discharge of a brush into or from the container so that mascara adhered to the brush is scraped by a second wiper formed on a rear end portion of the wiper body when the brush rod is discharged and configured to prevent the brush from coming into contact with an inner surface of the wiper body while being moved along the wiper body by pressure applied from the brush rod that is being discharged; and a separation-preventing member mounted to a rear end of the wiper body so as to prevent separation of the ring member and to guide movement of the brush rod, wherein, the ring member comprises:

a body having a tubular shape to define a hollow interior;

a first stepped locking portion formed on an inner circumferential surface of the body and configured to be caught by a discharge guidance protrusion of the brush rod so that the pressure is applied from the brush rod to the ring member when the brush rod is discharged from the container; and a second stepped locking portion formed on an outer circumferential surface of the body and configured to stop movement of the ring member when caught by a stepped movement control portion of the wiper body.

2. A double wiping structure of a toothbrush-type mascara wand, the structure comprising:

a wiper body mounted to an upper end portion of a container in which contents are stored and comprising a first wiper formed on a front end portion thereof to scrape mascara adhered to a brush rod that is being discharged from the container;

a ring member configured to guide introduction and discharge of a brush into or from the container so that mascara adhered to the brush is scraped by a second wiper formed on a rear end portion of the wiper body when the brush rod is discharged and configured to prevent the brush from coming into contact with an inner surface of the wiper body while being moved along the wiper body by pressure applied from the brush rod that is being discharged; and a separation-preventing member mounted to a rear end of the wiper body so as to prevent separation of the ring member and to guide movement of the brush rod, wherein the separation-preventing member comprises:

a body having a tubular shape to guide movement of the brush rod through a hollow interior thereof; and at least one fitting protrusion formed on an outer circumferential surface of the body.

3. The structure according to claim 2, further comprising a fitting space formed in the rear end portion of the wiper body so that the fitting protrusion is snap-fitted into the fitting space.

* * * * *